US006139802A

United States Patent [19]

Niermann et al.

[11] Patent Number: 6,139,802

[45] **Date of Patent: *Oct. 31, 2000**

[54] BALL AND SOCKET CLOSURE FOR SPECIMEN COLLECTION CONTAINER INCORPORATING A RESILIENT ELASTOMERIC SEAL

[75] Inventors: Volker Niermann, Little Falls; Don Carano, Flanders; Steve Savitz, Teaneck; Robert Gottlieb, Mahwah, all of N.J.

[73] Assignee: Becton, Dickinson and Company, Franklin Lakes, N.J.

[ * ] Notice: This patent is subject to a terminal disclaimer.

[21] Appl. No.: 09/288,897

[22] Filed: Apr. 9, 1999

Related U.S. Application Data

[63] Continuation of application No. 08/928,065, Sep. 12, 1997, Pat. No. 5,919,420.

[51] Int. Cl.[7] ..... B01L 3/00; B67D 3/00

[52] U.S. Cl. ..... 422/102; 422/99; 422/103; 222/507; 222/548; 222/558

[58] Field of Search ..... 222/505, 507, 222/534, 535, 542, 545, 548, 558; 422/99, 102, 103; 215/313

[56] References Cited

U.S. PATENT DOCUMENTS

| | | |
|---|---|---|
| 1,430,313 | 9/1922 | Millity . |
| 1,691,811 | 11/1928 | Johnson . |
| 1,726,642 | 9/1929 | Betts . |
| 1,747,550 | 2/1930 | Klimburg . |
| 1,882,180 | 10/1932 | Davidson et al. . |
| 2,030,696 | 2/1936 | Forster . |
| 2,032,776 | 3/1936 | Van Ness . |
| 2,120,510 | 6/1938 | Rhoads . |
| 2,126,814 | 8/1938 | Rest . |
| 2,135,848 | 11/1938 | Sandstrom . |
| 2,209,050 | 7/1940 | Church . |
| 2,558,671 | 6/1951 | Cherry . |
| 2,749,566 | 6/1956 | Thomas . |
| 2,779,519 | 1/1957 | Rossetti . |
| 2,805,801 | 9/1957 | Jacobs, et al. . |
| 2,885,128 | 5/1959 | Zimmerli . |
| 2,990,980 | 7/1961 | Gronemeyer . |

(List continued on next page.)

FOREIGN PATENT DOCUMENTS

| | | |
|---|---|---|
| 0 820 812A2 | 1/1998 | European Pat. Off. . |
| 447478 | 4/1949 | Italy . |
| 539850 | 2/1956 | Italy . |
| 5696111 | 11/1957 | Italy . |
| 50-3948 | 1/1975 | Japan . |
| 63-2162 | 8/1988 | Japan . |
| 5-170256 | 7/1993 | Japan . |
| 448119 | 6/1936 | United Kingdom . |
| 463118 | 3/1937 | United Kingdom . |
| 479200 | 2/1938 | United Kingdom . |

*Primary Examiner*—Jill Warden
*Assistant Examiner*—Dwayne K. Handy
*Attorney, Agent, or Firm*—Hoffmann & Baron, LLP

[57] ABSTRACT

A closure for sealing the open end of a specimen collection container from the environment is provided. The closure includes a generally spherical-shaped ball having a passageway extending therethrough, with the ball including an axle permitting rotative movement of the ball thereabout between an open position and a closed position. The closure further includes a socket mounted on the open end of the collection container, with the socket including a ball receiving internal surface having an axle-support for receiving the axle of the ball for accommodating rotative movement of the ball therein. The passageway of the ball is aligned with the open end of said collection tube when the ball is in an open position and is out of alignment with the open end of the collection container when the ball is in a closed position. The socket includes a ball receiving portion and a resilient elastomeric seal for maintaining the ball within the ball receiving portion and for providing a liquid-tight seal between the ball and the open end of the collection container.

20 Claims, 10 Drawing Sheets

U.S. PATENT DOCUMENTS 3,702,165 11/1972 Carow et al. .
3,703,249 11/1972 Middleton .
3,703,250 11/1972 Middleton .
3,782,608 1/1974 Schneider .
4,181,246 1/1980 Norris .
4,390,111 6/1983 Robbins et al. .
4,515,752 5/1985 Miramanda .
5,225,165 7/1993 Perlman .
5,433,716 7/1995 Leopardi et al. .
5,507,534 4/1996 Reifenberger et al. ..... 285/132
5,547,099 8/1996 Chang .

BALL AND SOCKET CLOSURE FOR SPECIMEN COLLECTION CONTAINER INCORPORATING A RESILIENT ELASTOMERIC SEAL

This application is a continuation of application Ser. No. 08/928,065, filed on Sep. 12, 1997 now U.S. Pat. No. 5,919,420.

FIELD OF THE INVENTION

The present invention is directed generally to a closure for a container. More specifically, the present invention relates to a ball and socket closure for use with specimen containers for biological and non-biological samples.

BACKGROUND OF THE INVENTION

Medical specimens, for example, biological and non-biological fluids, solids and semi-solids, are routinely collected and analyzed in clinical situations for various purposes. In particular, biological fluids such as blood, urine, and the like are typically collected in a specimen collection container which is in the shape of an open-ended tube. Such a tube is generally in the form of an elongate cylindrical member having one end open and an opposing end permanently closed by an integral semi-spherical portion, with the tube defining an interior which collects and holds the specimen.

After a biological sample has been drawn and/or collected in the tube, the tube with the sample is typically transported to a clinical testing laboratory for analysis. For example, blood samples may undergo routine chemistry, hormone, immunoassay or special chemical testing. In order to conduct such testing, the sample is normally transferred from the primary tube in which the sample was collected into one or more secondary tubes for testing and analysis, oftentimes to effect simultaneous testing in two or more different areas. In order to minimize contamination, evaporation and spilling during transportation, analysis and storage, it is important to maintain the open end of the tube with a closure.

The open end of a specimen container is typically sealed by a resilient cap, a removable rubber stopper, or plastic film during transport and analysis. Such closures provide means for sealing the open end of the tube, but are not capable of being efficiently removed, stored and replaced without causing contamination and with the use of one hand, as is often desired in clinical environments. Furthermore, when using analytical testing equipment for testing biological samples, it is typically necessary to maintain the samples in an open container to allow a probe from the testing equipment to be inserted into the container. In view of these needs, it is desirable to have a closure that can be easily and repeatedly opened and closed for manual or automated access.

One particularly useful type of closure for containers is a ball and socket type closure. While a number of ball and socket type closures for various containers are known, none are entirely effective for use in specimen collection containers, where an adequate seal is essential.

Accordingly, it is desirable to provide a closure for a specimen collection container which can be easily and repeatedly opened and closed and which can effectively provide an adequate seal.

SUMMARY OF THE INVENTION

It is an object of the present invention to provide a closure for a specimen collection container which can be easily manufactured.

It is a further object of the present invention to provide a closure capable of being easily and repeatedly opened and closed.

It is yet a further object of the present invention to provide a closure for a specimen collection container which can be repeatedly opened and closed while maintaining an adequate seal.

In the efficient attainment of these and other objects, the present invention provides a closure for sealing the open end of a specimen collection container from the environment. The closure includes a generally spherical-shaped ball including a passageway extending therethrough, with the ball having an axle for permitting rotative movement of the ball between an open position and a closed position. The passageway is aligned with the open end of the collection container when the ball is in an open position and is out of alignment with the open end of the collection container when the ball is in a closed position. The closure further includes a socket mountable on the open end of the collection container for accommodating rotative movement of the ball between an open position and a closed position. The socket includes a ball receiving portion having a ball receiving internal surface for accommodating rotative movement of the ball, and a resilient elastomeric seal for maintaining the ball within the ball receiving portion upon rotative movement thereof and for providing a seal between the ball and the open end of the collection container.

The socket may further include a ball seat which is mountable to the open end of the collection container for supporting the elastomeric seal. The ball seat and the resilient elastomeric seal may be separate components or may be integral with each other. Preferably, the resilient elastomeric seal is in the form of a perimetrical ring which is o-shaped, and which is contained within the ball seat.

The ball seat may include a depending cylindrical portion for engagement with an internal surface of the open end of the collection tube. The depending cylindrical portion may include outwardly directed annular ribs for engagement with the collection tube.

Preferably, the ball receiving portion is longitudinally coupled to the ball seat, which coupling urges the ball into sealing engagement with the resilient elastomeric seal. The ball receiving portion and the ball seat may include cooperating threaded surfaces for threaded connection therebetween. Further, the cooperating threads may include a stop for preventing threaded disengagement of the ball receiving portion from the ball seat.

In an alternate embodiment, the resilient elastomeric seal includes a perimetrical ring capable of engaging a perimeter of the open end of the collection tube, and the ball receiving portion includes an annular flange for engagement with an external surface of the open end of the collection container. The annular flange may snap fit over the open end of the collection container, or may include internal threads on an internal surface thereof for threaded engagement with cooperating threads on an external surface of the open end of the collection container. Such threaded engagement of the ball receiving portion and the external surface of the collection container urges the ball into sealing engagement with the resilient elastomeric seal. Further, such cooperating threads may include a stop for preventing threaded disengagement of the ball receiving portion from the collection container.

In preferred embodiments, the ball receiving internal surface of the socket includes an axle-support for receiving the axle of the ball for accommodating rotative movement of the ball. The axle-support of the socket and the axle of the ball may be parallel and eccentric with respect to each other. Preferably, the axle of the ball includes a pair of opposed protrusions on opposed surfaces thereof and the axle-support of the socket includes a generally spherical internal surface having a pair of opposed cavities, with the opposed protrusions of the ball engaging the opposed cavities of the socket. Further, the pair of opposed protrusions may be generally cylindrical-shaped with the pair of opposed cavities including a pair of generally cylindrical bores for engagement therewith. Alternatively, the pair of opposed cavities of the socket may include a pair of tapered surfaces with the pair of opposed protrusions of the ball include a pair of corresponding drafted surfaces for engagement therewith.

DETAILED DESCRIPTION OF THE PREFERRED EMBODIMENTS

The present invention may be described as a ball and socket closure for use with specimen collection containers. For purposes of the present invention, the term specimen collection container is used to represent any type of container useful for collecting, transferring, analyzing or storing a biological or non-biological sample, for example primary and secondary specimen tubes for blood collection and analysis.

The present invention takes the form of a ball and socket closure for a collection container capable of providing an adequate seal, and which is capable of preventing or minimizing transfer of contaminants between the external environment and the internal contents of the container.

Figure 1:
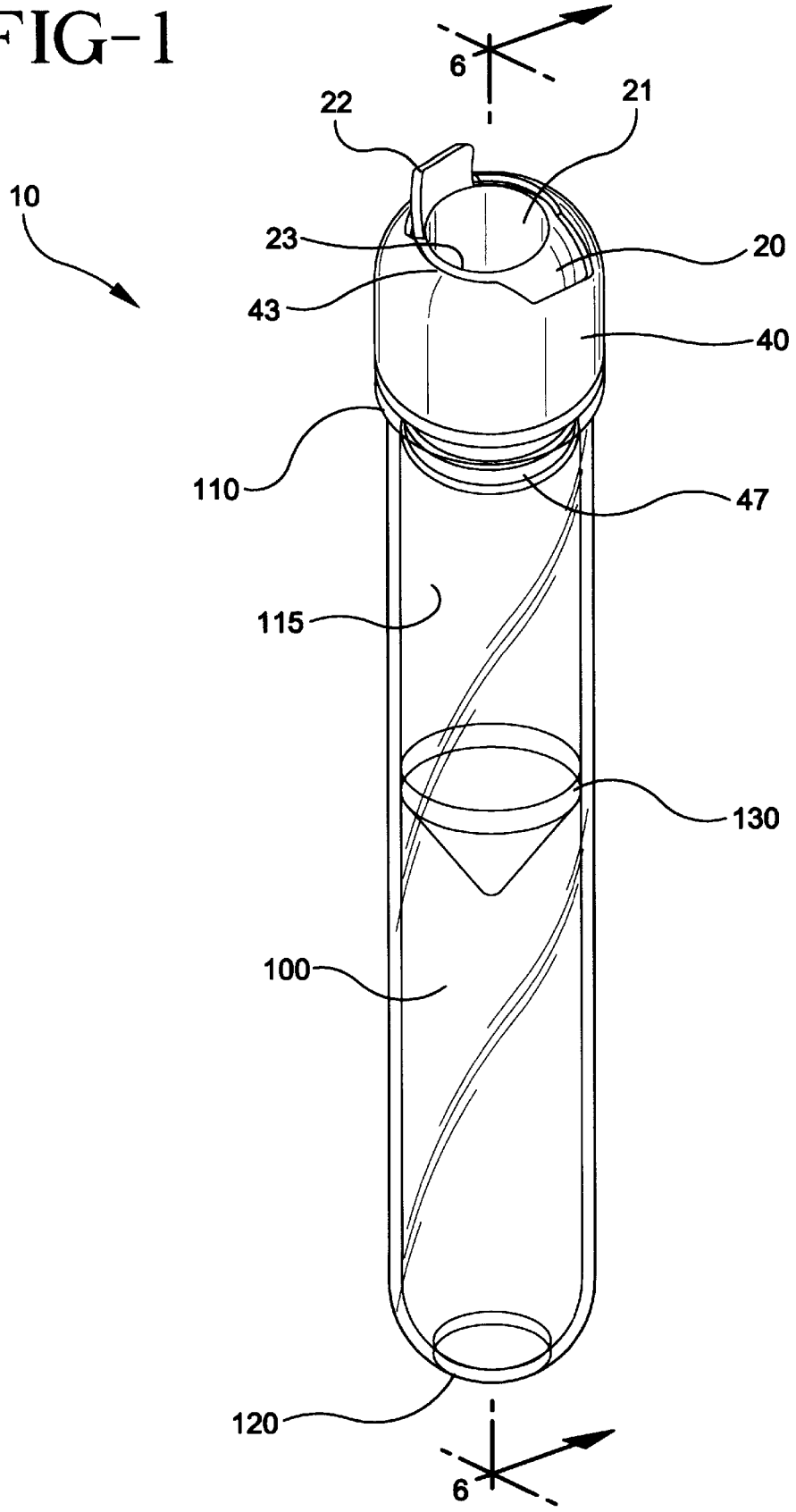
FIG. 1 represents a perspective view of a specimen collection assembly including the closure of the present invention depicted in an open state.
Figure 2:
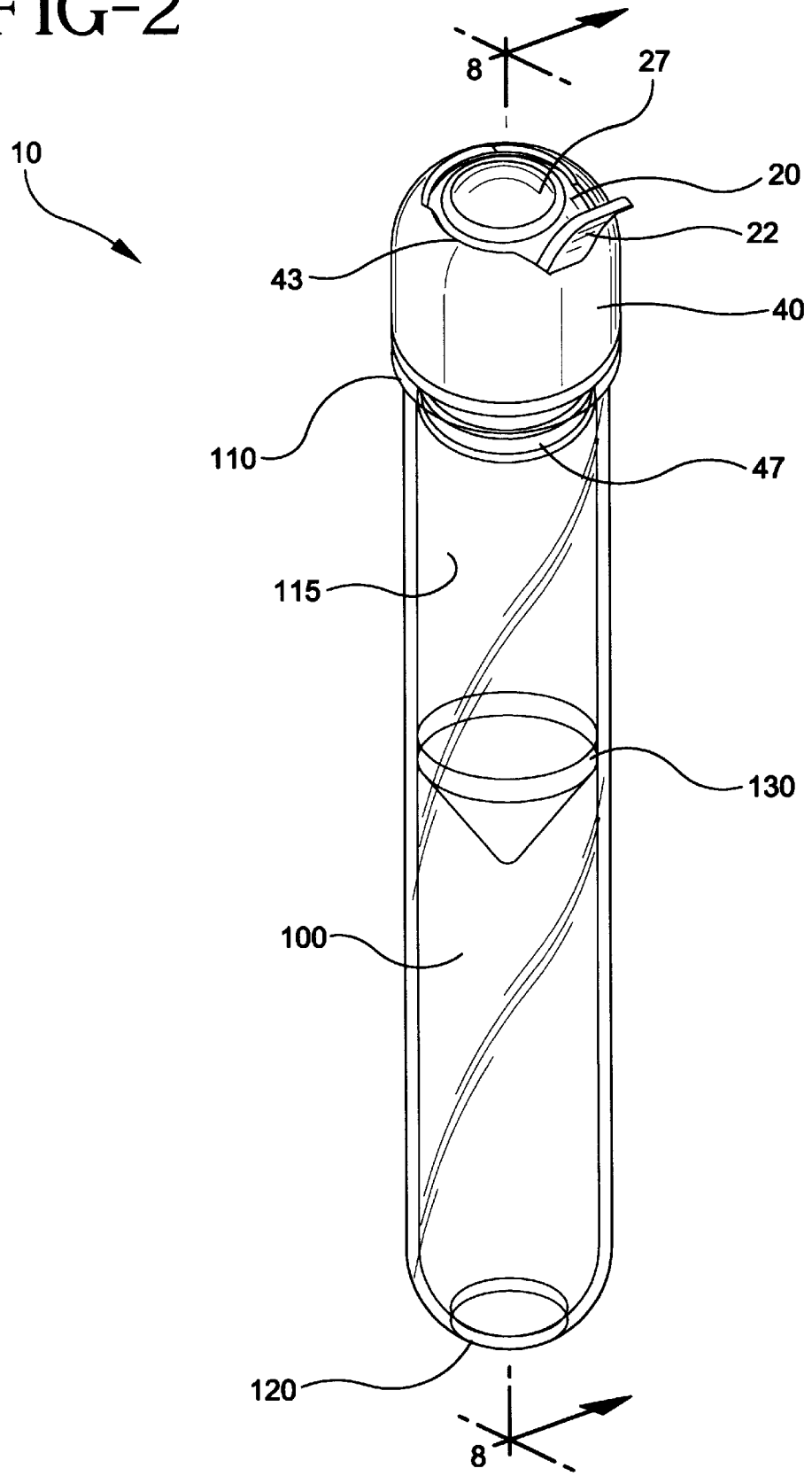
FIG. 2 represents a perspective view of a specimen collection assembly including the closure of the present invention depicted in a closed state.

With specific reference to the embodiment of FIGS. 1 and 2, a closure 10 is shown positioned over a blood collection tube 100, respectively, in an open and closed position. Closure 10 is adapted for interfitting engagement with collection tube 100 at open end 110 thereof. Collection tube 100 may be any type of collection tube known in the art, and may be constructed of any known material such as glass or, more preferably, a suitable plastic. Preferably, collection tube 100 is a false-bottom tube, including open end 110 at the top thereof and an opposed open bottom end 120, with a conical bottom 130 located between open end 110 and bottom end 120. Conical bottom 130 provides collection tube 100 with an upper chamber 115 for holding small volumes of liquid. Such a structure allows for easy access to liquid contained in upper chamber 115 when utilizing a manual transfer pipette or an automated sample probe from a clinical analyzer. By incorporating conical bottom 130, collection tube 100 can be used with standard holders and analyzer equipment without the need for such a pipette or probe to travel the full length of collection tube 100 to access the sample contained therein.

Closure 10 includes a generally spherical-shaped socket 40 and a cylindrical protrusion 47 depending from a bottom end of closure 10. Cylindrical protrusion 47 is adapted for interfitting engagement within open end 110 of collection tube 100, thereby providing means for attaching closure 10 to collection tube 100. Cylindrical protrusion 47 may be adapted for intermitting engagement with collection tube 100 in any known manner, for example by snap-fit, frictional fit, threaded engagement, and the like. In this manner, closure 10 may be firmly fitted and attached to collection tube 100 in a liquid-tight manner, and may be easily removed from collection tube 100 if desired.

Figure 3:
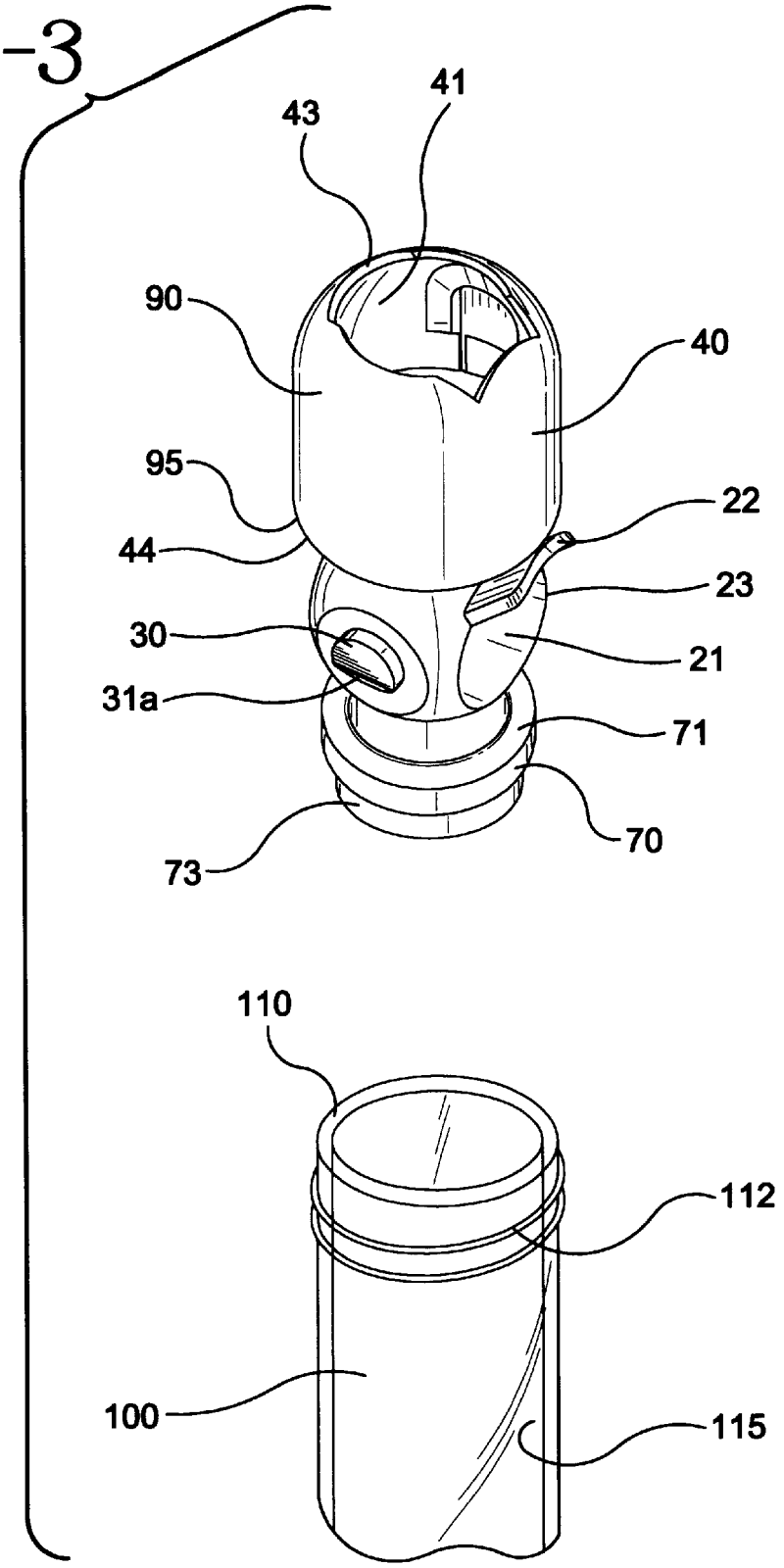
FIG. 3 represents a perspective view of the closure of the present invention shown unassembled.
Figure 4:
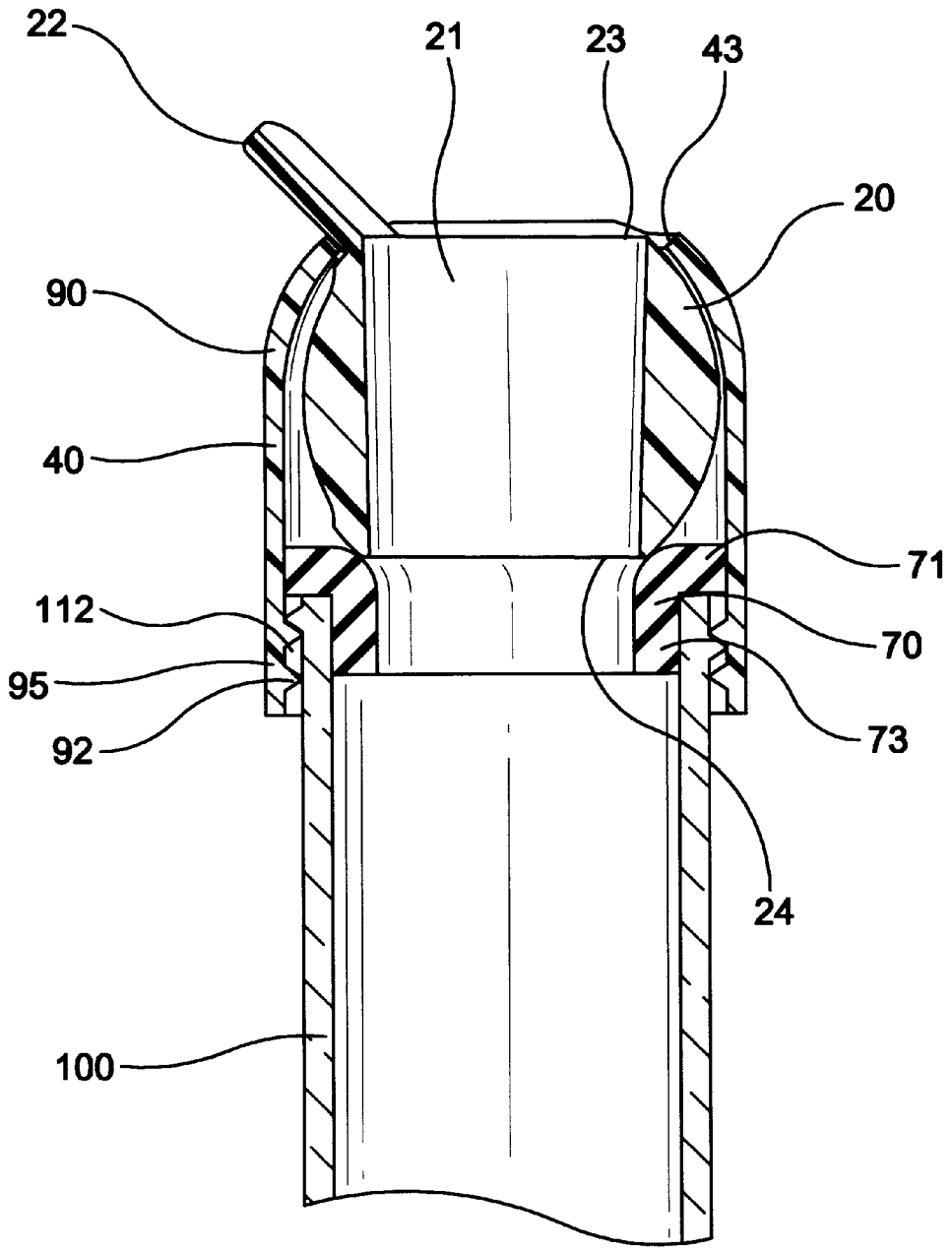
FIG. 4 represents a cross-sectional view of a closure according to one embodiment of the present invention.
Figure 5:
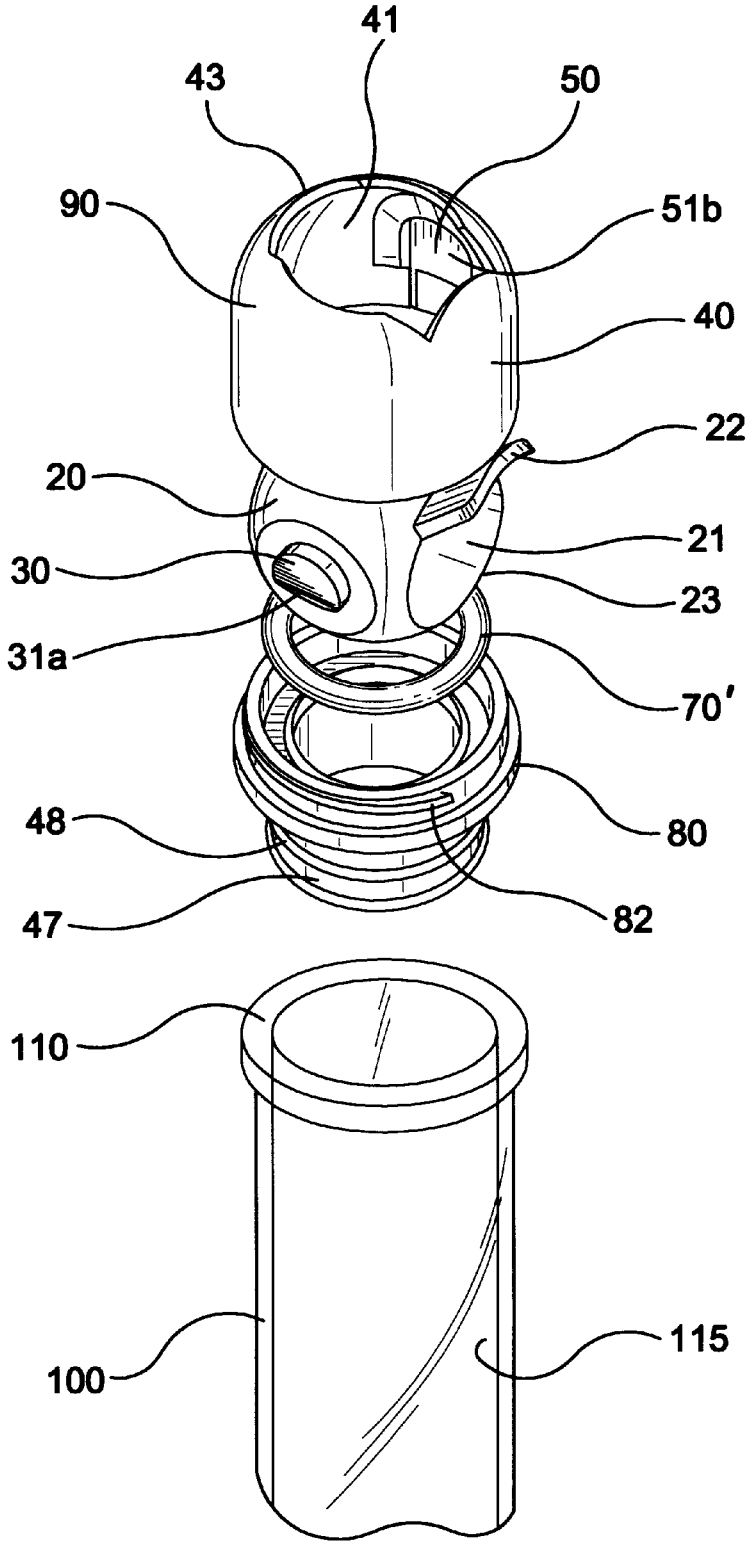
FIG. 5 represents a perspective view of a closure in a preferred embodiment of the present invention shown unassembled.
Figure 6:
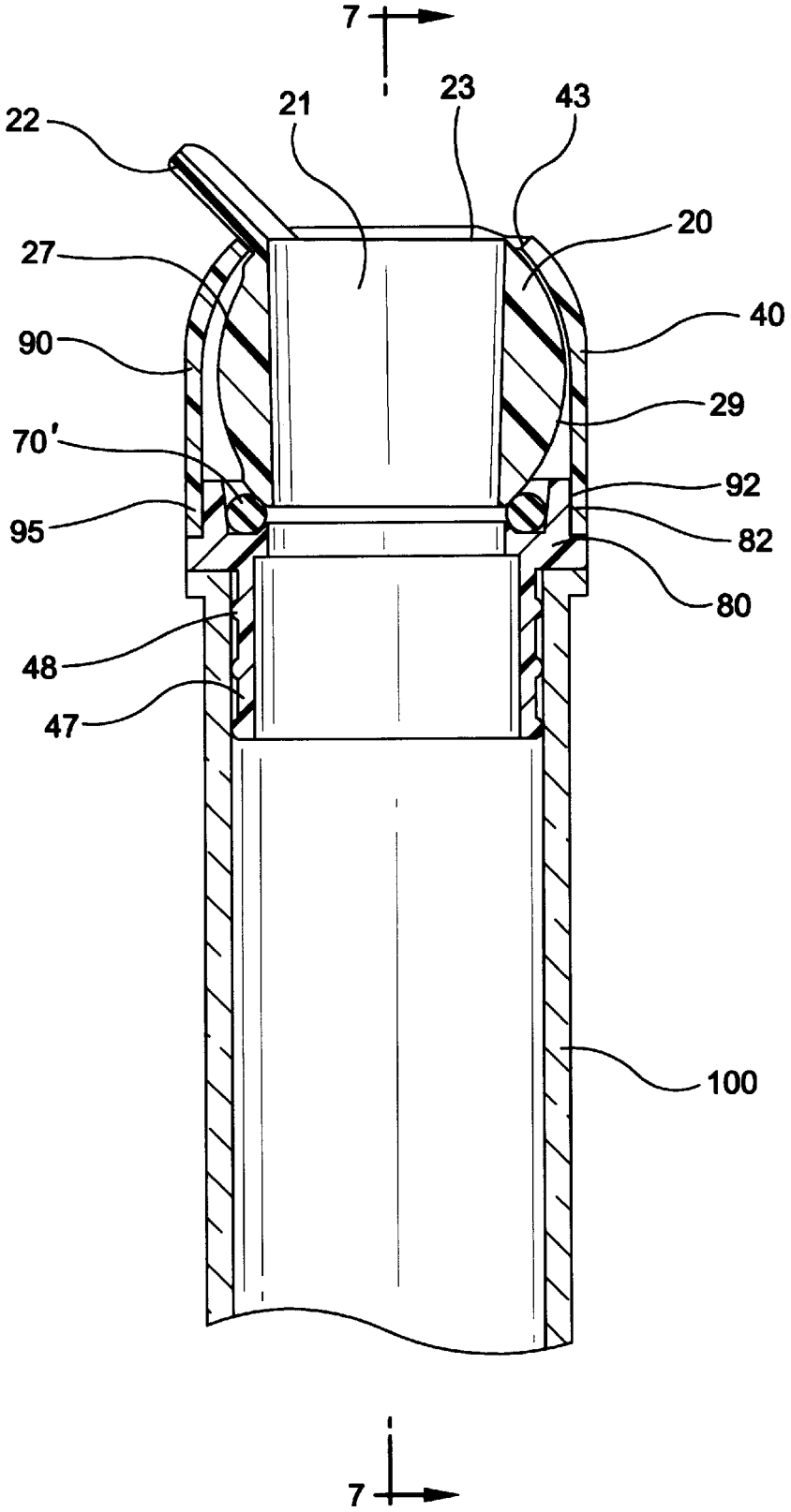
FIG. 6 represents a cross-sectional view of the preferred closure of FIG. 5 in an open state taken along line 6—6 of FIG. 1.

As shown in FIG. 3 and 4, closure 10 further includes a generally spherically-shaped ball 20 fitted within socket 40. Ball 20 includes a passageway 21 extending therethrough. Preferably, passageway 21 is in the form of a cylindrical bore, which extends through ball 20 from a first open end 23 of ball 20 to an opposed second open end 24 of ball 20. Passageway 21 provides an opening through ball 20 for permitting access between the outside environment and upper chamber 115 of collection tube 100, as will be discussed in more detail herein.

The internal diameter of passageway 21 should be large enough to allow access of a probe therethrough and to allow fluid flow therethrough. It is important, however, that the overall outside diameter of closure 10 must not be too large. For example, if the outside diameter of closure 10 or socket 40 is significantly larger than the outside diameter of a standard collection tube, collection tube 100 with closure 10 assembled thereon may not properly fit or function in conventional testing equipment. More particularly, closure 10 is particularly useful in testing environments where conventional covers would need to be removed from a collection container prior to testing of the sample. As such, collection tubes typically conform to a standard size to be useful with such equipment. As closure 10 of the present invention may be used during analysis without the need to remove the entire closure 10 from collection tube 100, closure 10 preferably is capable of fitting within the boundary of such standard size testing equipment without the need for removal thereof. Therefore, the outside diameter of closure 10 or socket 40 is preferably less than approximately 19.05 millimeters in order to properly function with standard equipment. With such an outside diameter, the internal diameter of passageway 21 is preferably approximately 10.5 millimeters. In alternate embodiments, closure 10 may be of a sufficient diameter such that, when coupled to collection tube 100, closure 10 is capable of supporting collection tube 100 in various testing equipment such as storage racks, carousels, etc.

As noted above, ball 20 fits within socket 40 to form closure 10. Socket 40 includes a ball receiving portion 90 and a resilient elastomeric seal 70. Socket 40 further includes a first open end 43 defining a perimetrical opening at the top of ball receiving portion 90 which is open to the external environment, and a second open end 44 at the bottom end thereof which is open to the interior of collection tube 100. First open end 43 may include a contoured pouring surface for facilitating pouring of the contents of collection tube 100.

Ball receiving portion 90 of socket 40 includes a ball-receiving internal surface 41, for interfitting engagement with the outside surface of ball 20. Internal surface 41 includes a generally semi-spherical-shaped hollow opening which accommodates the shape of ball 20. Ball 20 fits within ball receiving portion 90 of socket 40 in a contacting relation between the external surface of ball 20 and the perimeter of first open end 43 of ball receiving portion 90, so as to establish sealing engagement between ball 20 and socket 40 at first open end 43.

As shown in FIGS. 3 and 4, socket 40 includes a resilient elastomeric seal 70 positioned for engagement between ball 20, ball receiving portion 90 and open end 110 of collection tube 100. Elastomeric seal is constructed of a resilient elastomeric material, for example, rubber, silicone, or the like. Elastomeric seal 70 is generally ring-shaped having an upper generally flat annular surface 71 and a depending cylindrical portion 73. The upper annular surface 71 provides a support surface for accommodating the ball 20 in sealing engagement and for maintaining ball 20 within ball receiving portion 90 upon rotative movement of ball 20 within socket 40. Depending annular portion 73 provides a seal between ball 20 and open end 110 of collection tube 100.

In such an embodiment, ball receiving portion 90 may include an annular flange 95 for engagement with an external surface of collection tube 100 when closure 10 is mounted thereon. Annular flange 95 may engage collection tube 100, for example, in a snap fit engagement, a friction fit engagement, a threaded engagement, or the like. Such engagement of annular flange 95 with the external surface of collection tube 100 urges ball 20 into sealing engagement with elastomeric seal 70. In preferred embodiments, annular flange 95 includes internal threads 92 on an internal surface thereof, for threaded engagement with cooperating threads 112 on the external surface of open end 110 of collection tube 100. Further, such cooperating threads may be capable of preventing disengagement of annular flange 95 and collection tube 100. Such means for preventing disengagement is preferably a stop.

FIGS. 5–9 depict closure 10 in an alternate embodiment, wherein socket 40 further includes an annular ball seat 80. Ball seat 80 includes ball accommodating upper portion 81 and cylindrical portion 47 depends from a lower portion of ball seat 80, thereby providing means for attaching closure 10 to collection tube 100. Ball seat 80 provides a seat for ball 20 permitting rotation between an open and closed position within socket 40. Ball seat 80 further supports an elastomeric o-ring 70' forming an elastomeric seal.

Ball receiving portion 90 is longitudinally coupled to ball seat 80 by any known method, for example by a snap fit, frictional fit, or threaded engagement. Such longitudinal coupling urges ball 20 into sealing engagement with o-ring 70'. Preferably, ball receiving portion 90 and ball seat 80 include cooperating threaded surfaces 92 and 82, respectively, for threaded connection therebetween. Further, such cooperating threads may be capable of preventing disengagement of cooperating threaded surfaces 92 and 82, to prevent threaded disengagement of ball receiving portion 90 and ball seat 80. Such means for preventing disengagement is preferably a stop.

Figure 10:
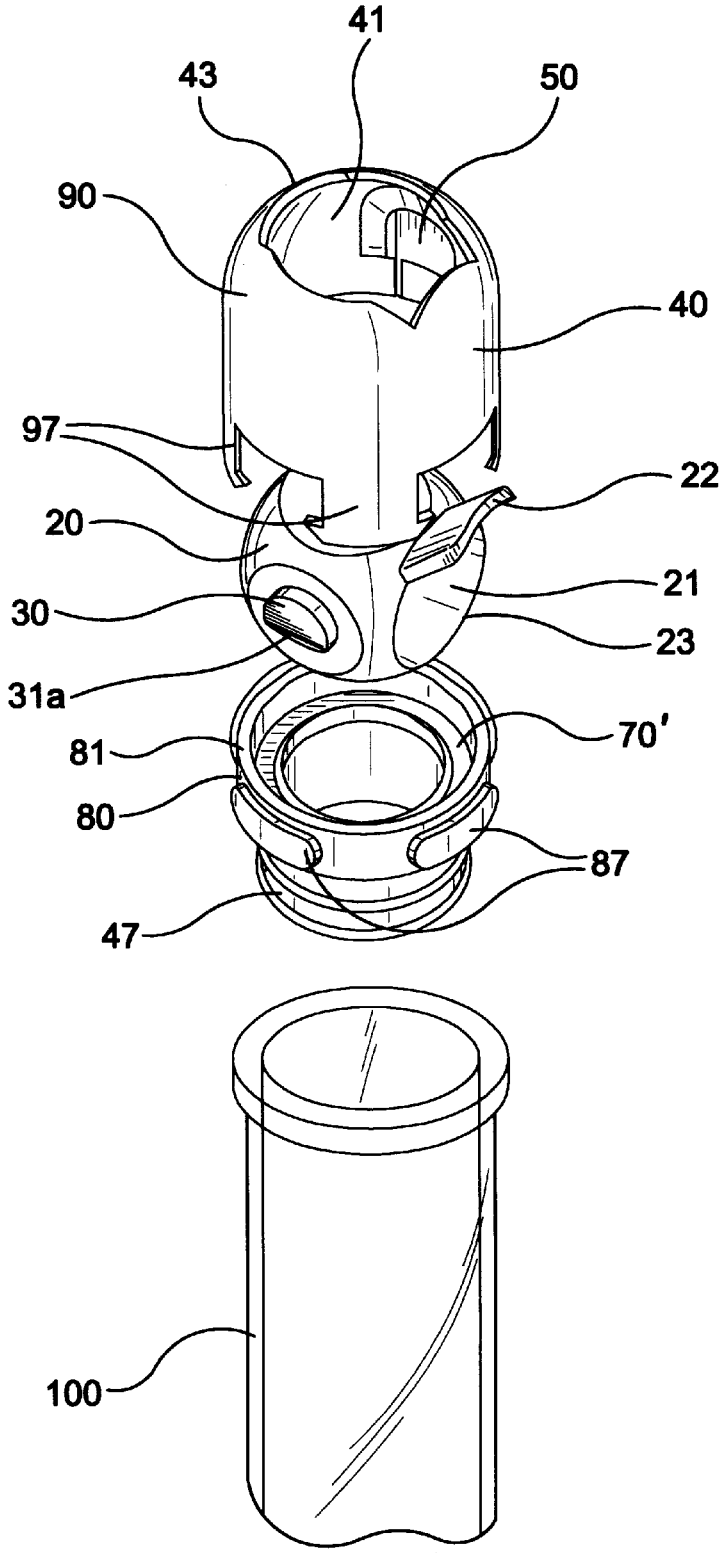
FIG. 10 represents a perspective view of a further embodiment of the closure of the present invention shown unassembled.

Alternatively, as shown in FIG. 10, ball receiving portion 90 may include clasps 97 for interlocking engagement with ball seat clips 87 on an external surface of ball seat 80. Such interlocking engagement prevents ball receiving portion 90 and ball seat 80 from becoming unattached.

Figure 7:
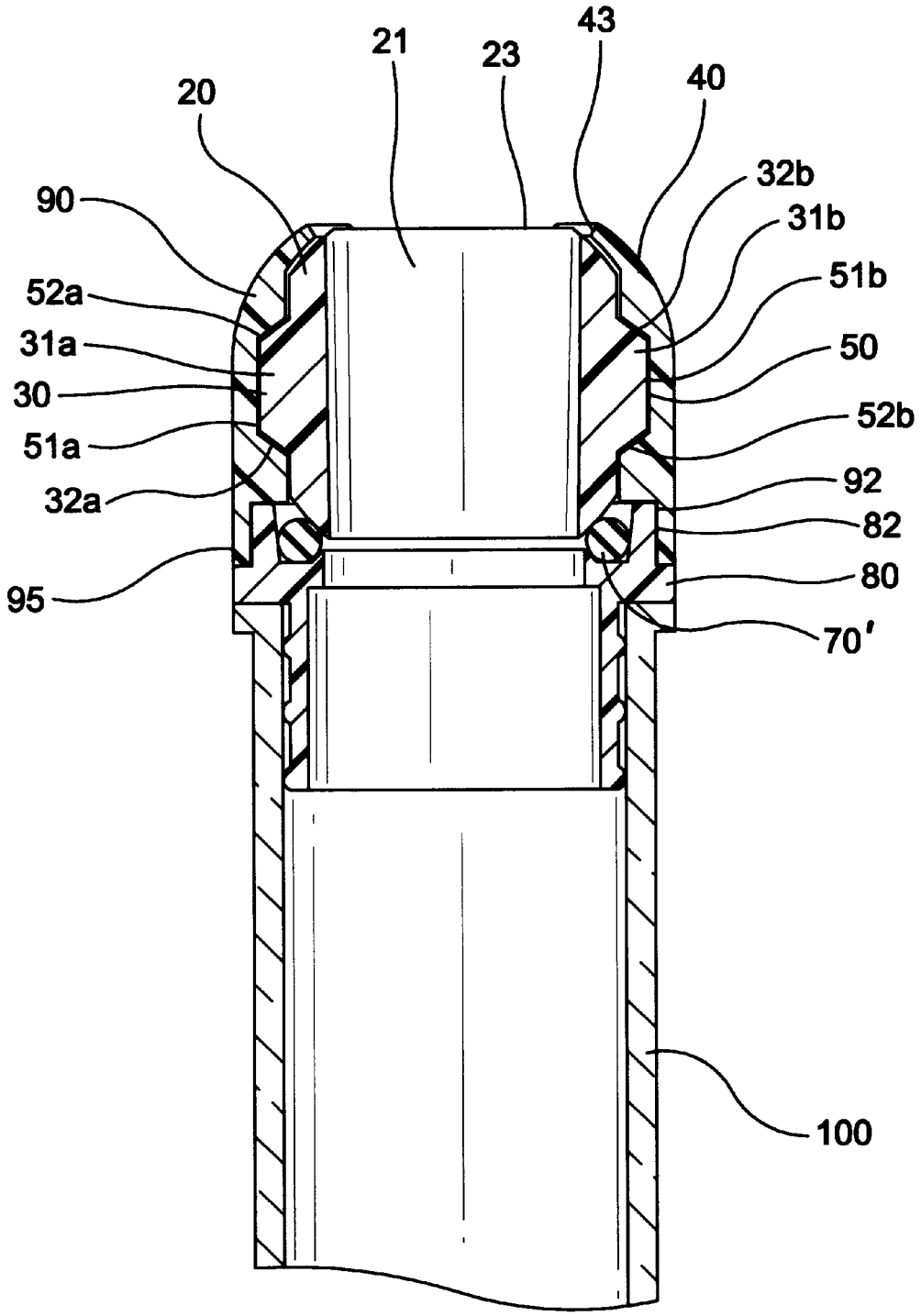
FIG. 7 represents a cross-sectional view of the preferred closure of FIG. 5 in an open state taken along line 7—7 of FIG. 6.
Figure 9:
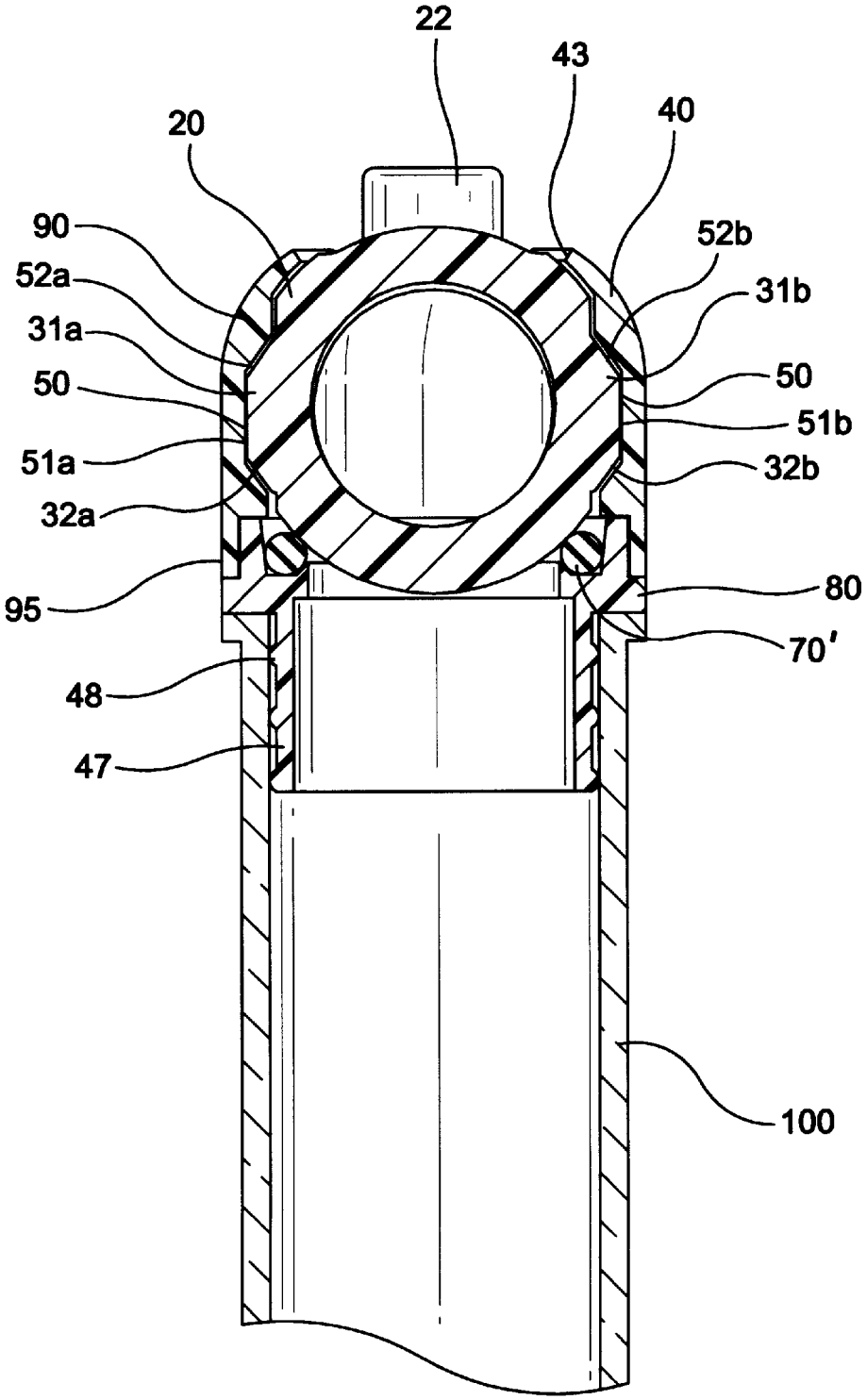
FIG. 9 represents a cross-sectional view of the preferred closure of FIG. 5 in a closed state taken along line 9—9 of FIG. 8.

As indicated, ball 20 is intermitted within socket 40 for rotative movement therein. Ball 20 further includes an axle 30. Axle 30 permits rotative movement of ball 20 within socket 40 about an axis between an open position and a closed position, as will be discussed in more detail herein. Axle 30 is preferably defined by a pair of opposed protrusions 31*a* and 31*b* on opposed surfaces of ball 20, as best seen in FIGS. 7 and 9. Opposed protrusions 31*a* and 31*b* may be cylindrical-shaped protrusions, or alternatively, may include drafted surfaces 32*a* and 32*b*, to correspond with tapered surfaces 52*a* and 52*b* of socket 40, as will be discussed in further detail herein. Alternatively, axle 30 may be defined by a pair of opposed cavities on opposed surfaces of ball 20, which opposed cavities engage with opposed protrusions within socket 40.

Internal surface 41 includes axle-support 50 for receiving axle 30 of ball 20. Axle-support 50 is comprised of recessed cavities 51*a* and 51*b* at diametrically opposed sides thereof. Such opposed cavities 51*a* and 51*b* provide for interfitting engagement with opposed protrusions 31*a* and 31*b* of ball 20. Further, opposed cavities 51*a* and 51*b* may include tapered surfaces 52*a* and 52*b*, respectively, therein for engagement with drafted surfaces 32*a* and 32*b* of ball 20. With ball 20 fitted within socket 40 in this manner, axle 30 provides for rotative movement of ball 20 thereabout within axle-support 50 of socket 40. In an alternate embodiment where ball 20 includes opposed cavities acting as axle 30 as noted above, axle support 50 may include opposed protrusions for interfitting engagement with such opposed cavities of ball 20.

Rotative movement of ball 20 about axle 30 can be effected manually by providing ball 20 with externally accessible means for rotation such as tab 22 extending from the surface of ball 22. Tab 22 provides a protrusion for effecting movement of ball 20 within socket 40 by an operator's finger or thumb. Tab 22 may include a contoured pouring surface on a surface thereof for facilitating pouring of the contents of collection tube 100.

Rotation of ball 20 about axle 30 results in the alignment of first open end 23 of ball 20 with first open end 43 of socket 40 as well as alignment of second open end 24 of ball 20 with second open end 44 of socket 40. As such, a path is established by way of passageway 21 extending through ball 20 between the outside environment and upper chamber 115 of collection tube 100. Thus, rotation of ball 20 about axle 30 accomplishes movement of ball 20 between an open position when passageway 21 is in alignment with the interior of collection tube 100 through the alignment of first open ends 23 and 43 and second open ends 23 and 44 (shown in FIGS. 6 and 7), and a closed position when passageway 21 is out of alignment with the interior of collection tube 100 due to first open ends 23 and 43 and second open ends 23 and 44 being out of alignment with each other (shown in FIGS. 8 and 9).

Ball 20 is constructed and positioned within socket 40 so as to define an environment-contacting surface 27 and an opposed specimen- or liquid-contacting surface 29. When closure 10 is in a closed position, environment-contacting surface 27 is exposed to the external environment while liquid-contacting surface 29 is exposed to the interior of collection tube 100, i.e. upper chamber 115. When closure 10 is in an open position, environment-contacting surface 27 and liquid-contacting surface 29 are positioned within the semi-spherical-shaped hollow opening of ball receiving portion 90 which forms internal surface 41. In preferred embodiments, environment-contacting surface 27 includes means for identifying when ball 20 is in a closed position. Such identifying means may include indicia distinguishing between an open position and a closed position. For example, environment-contacting surface 27 may include a marking or wording thereon, or may include color coding signifying that the ball is in the closed position.

Alternately, such means for identifying when ball 20 is in a closed position includes the incorporation of a stop-indicating element on internal surface 41 of socket 40 for engagement with environment-contacting surface 27 when ball 20 is rotated to the closed position. For example, internal surface 41 of socket 40 may include dimple 42 at a location adjacent first open end 43 of socket 40. Dimple 42 may include a small protrusion extending from the internal surface 41 of socket 40. As will be discussed in more detail herein, dimple 42 provides an audible and tactile "click stop" feedback to the operator when environment-contacting surface 27 of ball 20 passes thereover, indicating that ball 20 has been fully rotated to the closed position. Alternatively, dimple 42 may include a protrusion 42*a* extending along a length of internal surface 41 of socket 40, as shown in FIG. 17. Such protrusion 42*a* provides an operator with an audible and tactile "click-stop" feedback to indicate that ball 20 has been fully rotated to both the open and closed positions, as will be discussed.

As indicated above, axle 30 of ball 20 is defined by opposed protrusions 31*a* and 31*b*, and axle-support 50 of socket 40 is defined by opposed cavities 51*a* and 51*b*. When closure 10 is assembled, axle 30 is received in axle-support 50, i.e., opposed protrusions 31*a* and 31*b* are supported within opposed cavities 51*a* and 51*b*. Closure 10 maybe adapted for symmetric rotation of ball within socket 40 about axle 30. Alternately, closure 10 may be adapted for non-symmetric rotation of ball 20 within socket 40 about axle 30, as described in detail in U.S. application Ser. No. 08/920,064 entitled "Ball and Socket Closure for Specimen Collection Container" filed concurrently herewith and incorporated herein by reference. In order to effect non-symmetric rotation of ball 20 within socket 40, axle 30 and axle-support 50 are parallel and eccentric with respect to each other. Such non-symmetric rotation provides for improved liquid-tight sealing of closure 10 between ball 20 and socket 40.

Further, as noted above, when closure 10 is in an open position, environment-contacting surface 27 and liquid-contacting surface 29 are positioned within the sphere-shaped hollow opening of socket 40 which forms internal surface 41. Environment-contacting surface 27 is preferably recessed from the general spherical shape of ball 20, such that when closure 10 is in an open position, annular space 37 is provided between environment-contacting surface 27 and internal surface 41 of socket 40, thus maintaining a non-contacting relation therebetween. This non-contacting relation prevents contamination between environment-contacting surface 27 and interior surface 41.

In a further embodiment of the present invention, closure 10 may include a locking mechanism for preventing rotational movement of ball 20 within socket 40, for example a clip, strap, band, or the like, for securing ball 20 in a closed position during transport or storage, or in an open position during use. Alternatively, rotative movement of ball 20 within socket 40 may be effected through the longitudinal coupling of ball receiving portion 90 and ball seat 80. For example, as noted, the longitudinal coupling of ball receiving portion 90 and ball seat 80 urges ball 20 into sealing engagement with elastomeric seal 70. By coupling ball receiving portion 90 and ball seat 80 in a tight manner, ball 20 is tightly urged into sealing engagement with elastomeric seal 70, thereby preventing rotative movement of ball 20 within socket 40. This can be accomplished, for example, by providing ball receiving portion 90 and ball seat 80 with cooperating threads, which threads can be tightened to longitudinally urge ball 20 into sealing engagement with elastomeric seal 70 and prevent movement of ball 20 within socket 40 or loosened to permit such rotative movement.

Figure 8:
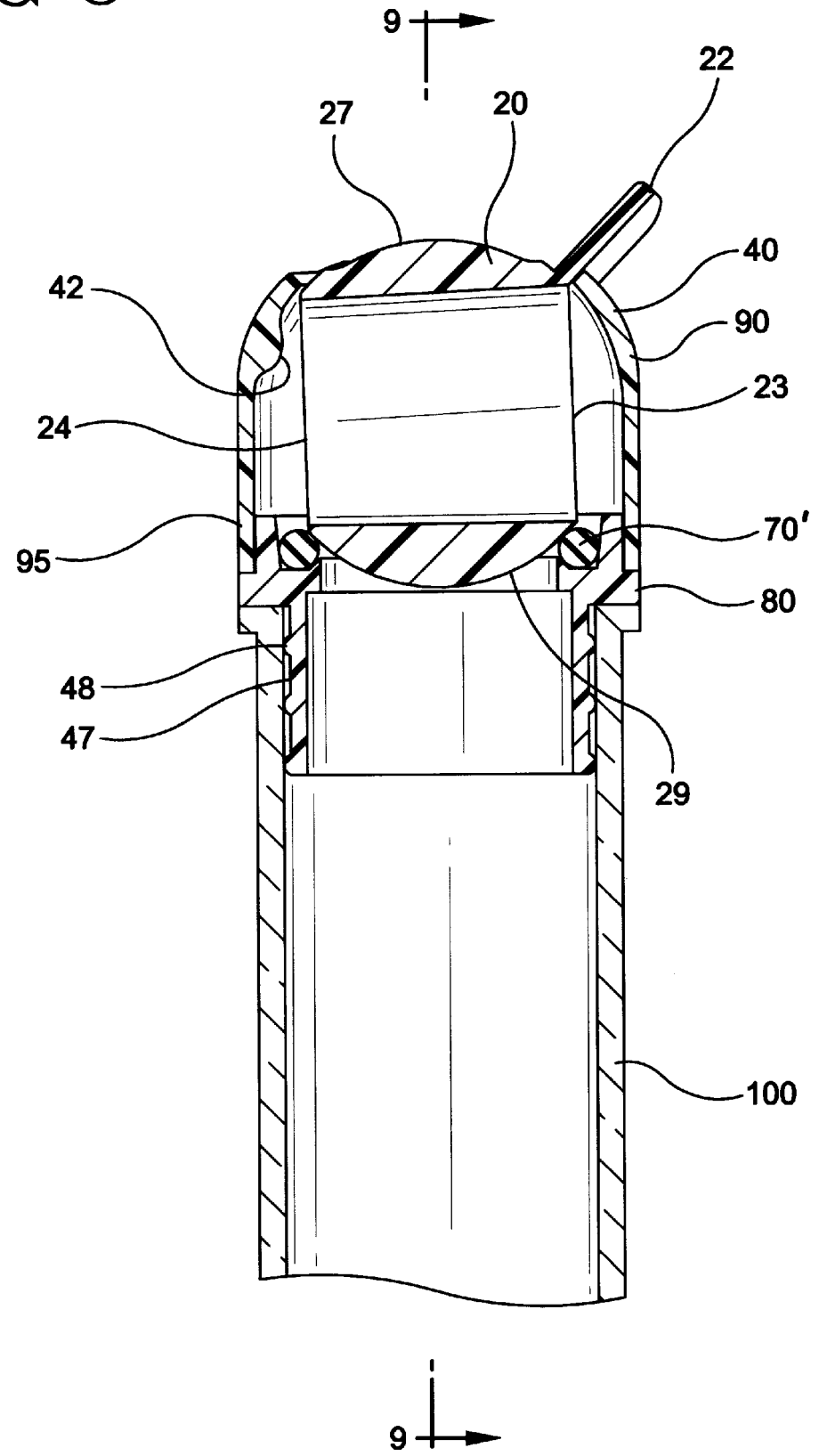
FIG. 8 represents a cross-sectional view of the preferred closure of FIG. 5 in a closed state taken along line 8—8 of FIG. 2.

In use, closure 10 including ball 20 fitted within socket 40 is provided for engagement at open end 110 of collection tube 100 with ball receiving portion 90 and ball seat 80 in tightly threaded engagement to prevent movement of ball 20 within socket 40. This threaded engagement is loosened by partially unthreading ball receiving portion 90 from ball seat 80, to permit rotational movement of ball 20 within socket 40. Rotational movement of ball 20 within socket 40 about axle 30 accomplishes opening and closing of closure 10. For example, when closure 10 is in the closed position as shown in FIGS. 2, 8 and 9, environmental-contacting surface 27 is positioned within first open end 43 of ball receiving portion 90 and is exposed to the external environment while liquid-contacting surface 29 of ball 20 is positioned for exposure to upper chamber 115 of collection tube 100. The external surface of ball 20 contacts elastomeric seal 70 in a sealing engagement, thus preventing any fluid contained within collection tube 100 from passing beyond elastomeric seal 70 and between ball 20 and socket 40. An operator's finger engages tab 22 of ball 20, and applies pressure to tab 22 in a direction toward environmental-contacting surface 27. Such pressure transmits a force to ball 20 about axle 30, thus causing ball 20 to rotate about axle 30 within socket 40. This rotative movement causes liquid-contacting surface 29 to engage elastomeric seal 70, and the continuous rotative movement of ball 20 provides for a wiping action between elastomeric seal 70 and liquid-contacting surface 29. Accordingly, any blood or other contaminant which is present on liquid-contacting surface 29 is wiped from the surface thereof by elastomeric seal 70.

Full rotation of ball 20 within socket 40 is accomplished by moving tab 22 completely across first open end 43 of socket 40, with tab 22 resting on the perimeter of first open end 43. During this rotation, opposed protrusions 31*a* and 31*b* of ball 20 engage opposed cavities 51*a* and 51*b* of socket 40. As elastomeric seal 70 is resilient and flexible, elastomeric seal 70 flexes with the longitudinal movement of ball 20, thereby maintaining a contacting relation between elastomeric seal 70 and ball 20 to maintain a liquid-tight seal. Upon full rotation of ball 20 within socket 40, liquid-contacting surface 29 is rotated to a position within internal surface 41 of ball receiving portion 90. The recessed nature of environmental-contacting surface 27 with respect to the overall sphere-shape of ball 20 causes environmental-contacting surface 27 to be rotated to a position within ball receiving portion 90 in a non-contacting relation with internal surface 41 of socket 40.

Such full rotation of ball 20 within socket 40 by moving tab 22 completely across first open end 43 of socket 40 results in closure 10 being rotated to its open position. This open position effects the alignment of first open end 23 of ball 20 with first open end 43 of socket 30 as well as alignment of second open end 24 of ball 20 with second open end 44 of socket 40, resulting in passageway 21 extending through ball 20 between the outside environment and upper chamber 115 of collection tube 100. This alignment establishes a path for insertion of a probe or for pouring of fluids contained within upper chamber 115, directly through passageway 21.

After effecting such use, closure 10 can be returned to its closed position by applying pressure to tab 22 in a direction opposite of that to open closure 10, i.e., in a direction toward passageway 21 of ball 22. Such pressure transmits a force to ball 20 about axle 30 in a similar manner as that exerted during opening of closure 10, thus causing ball 20 to rotate about axle 30 within socket 40 in an opposite direction as that used to open closure 10. This rotative movement causes liquid-contacting surface 29 to travel back across elastomeric seal 70, to its original position where it is exposed to upper chamber 115 of collection tube 100.

Further, such rotational movement causes environmental-contacting surface 27 to travel back across the perimeter of first open end 43 of socket 40 to its original position where it is exposed to the external environment. As environmental-contacting surface 27 is recessed with respect to the overall sphere defining the shape of ball 20, it does not contact inside surface 41 of ball receiving portion 90 during such travel. However, as environmental-contacting surface 27 returns to its original position, an edge of environmental-contacting surface 27 which defines the transition between the overall sphere-shape of ball 20 and the recessed portion of environmental-contacting surface 27 contacts dimple 42 as it passes thereover. Such contacting provides for an audible and tactile "click stop" feedback for the operator, thus providing an indication that ball 20 has been fully rotated within socket 40 to the closed position.

Still further, once ball 20 is fully rotated within socket 40 to the closed position with environmental-contacting surface 27 of ball 20 being rotated past dimple 42, flat edge 53 of opposed cavities 51*a* and 51*b* in socket 40 frictionally engages opposed protrusions 31*a* and 31*b* of ball 20. Such engagement exerts a further longitudinal force on ball 20 in a longitudinal direction within ball receiving portion 90 of socket 40, further forcing ball 20 onto elastomeric seal 70 and ball seat 80. Such longitudinal force provides the operator with positive feedback that ball 20 has been fully rotated to the closed position by way of an additional audible and tactile "click stop", and further ensures that a liquid-tight seal is maintained between ball 20 and socket 40 at ball seat 80.

Ball 20 and socket 40 can be made of any known materials useful for such purposes. Preferably, both ball 20 and socket 40 are constructed of thermoplastic materials. More preferably, both ball 20 and socket 40 are constructed of a rigid material. Most preferably, ball 20 and socket 40 are are made of a material selected from polystyrene or polypropylene.

Ball 20 and socket 40 can be manufactured using a variety of methods. Preferably, ball 20 and socket 40 are separately manufactured by molding procedures such as injection molding, and then assembled to form closure 10. Alternatively, ball 20 and socket 40 may be manufactured using a "dual-shot" or "two-shot" molding procedure, wherein ball 20 is fist molded and socket 40 is thereafter molded directly thereover. Various other molding and manufacturing methods are contemplated.

The closure of the present invention provides a number of improvements over prior art closures and techniques. In particular, the closure of the present invention minimizes splatter of liquid samples contained within a collection container. Additionally, there is no need to remove the closure to access the interior region of the collection container. The closure, however, may be removed from the collection container if desired. While the closure is capable of a firm attachment to the collection container, it is still capable of rotating independently of the container without the need for removal. The use of such an integrated closure permits ease of use for technicians with less risk of contamination in that there is a lower tendency to leave the collection container open since opening and closing of the container can easily be accomplished with a single hand.

Various other modifications to the foregoing disclosed embodiments will now be evident to those skilled in the art. Thus, the particularly described preferred embodiments are intended to be illustrative and not limited thereto. The true scope of the invention is set forth in the following claims.

What is claimed is:

1. A closure for sealing an open end of a specimen collection container from the environment comprising:

a generally spherical-shaped ball including a passageway extending therethrough and including an axle permitting rotative movement of said ball thereabout between an open position and a closed position, said passageway being aligned with said open end of said collection container when said ball is in said open position and being out of alignment with said open end of said collection container when said ball is in said closed position, and a socket mountable on said open end of said collection tube for accommodating said rotative movement of said ball between said open position and said closed position, said socket including a ball receiving portion having a ball receiving internal surface for accommodating said rotative movement of said ball, and a resilient elastomeric seal for maintaining said ball within said ball receiving portion upon rotative movement thereof and for providing a seal between said ball and said open end of said collection container, said socket further including a ball seat supporting said resilient elastomeric seal, said ball seat including a depending cylindrical portion for engagement with an internal surface of said open end of said collection container.

2. A closure as in claim 1, wherein said ball seat and said resilient elastomeric seal are integral.

3. A closure as in claim 1, wherein said ball seat and said resilient elastomeric seal are separate components.

4. A closure as in claim 1, wherein said resilient elastomeric seal comprises a perimetrical ring.

5. A closure as in claim 4, wherein said perimetrical ring is o-shaped.

6. A closure as in claim 1, wherein said depending cylindrical portion of said ball seat includes outwardly directed annular ribs for engagement with said internal surface of said open end of said collection container.

7. A closure as in claim 1, wherein said ball receiving portion is longitudinally coupled to said ball seat.

8. A closure as in claim 7, wherein said longitudinal coupling of said ball receiving portion urges said ball into sealing engagement with said resilient elastomeric seal.

9. A closure as in claim 8, wherein said ball receiving portion and said ball seat include cooperating threaded surfaces for threaded connection of said ball receiving portion to said ball seat.

10. A closure as in claim 9, wherein said cooperating threads include a stop for preventing threaded disengagement of said ball receiving portion from said ball seat.

11. A closure for sealing an open end of a specimen collection container from the environment comprising:

a generally spherical-shaped ball including a passageway extending therethrough and including an axle permitting rotative movement of said ball thereabout between an open position and a closed position, said passageway being aligned with said open end of said collection container when said ball is in said open position and being out of alignment with said open end of said collection container when said ball is in said closed position, and a socket mountable on said open end of said collection tube for accommodating said rotative movement of said ball between said open position and said closed position, said socket including a ball receiving portion having a ball receiving internal surface for accommodating said rotative movement of said ball, and a resilient elastomeric seal for maintaining said ball within said ball receiving portion upon rotative movement thereof and for providing a seal between said ball and said open end of said collection container, wherein said resilient elastomeric seal comprises a perimetrical ring having an upper generally flat annular surface and a depending cylindrical portion capable of engaging a perimeter of said open end of said collection container, and said ball receiving portion includes an annular flange for engagement with an external surface of said open end of said collection container.

12. A closure as in claim 11, wherein said annular flange snap fits over said external surface of said open end of said collection container.

13. A closure as in claim 11, wherein an internal surface of said annular flange and said external surface of said open end of said collection container include cooperating threads for threaded engagement therebetween.

14. A closure as in claim 13, wherein said threaded engagement of said ball receiving portion and said external surface of said open end of said collection container urges said ball into sealing engagement with said resilient elastomeric seal.

15. A closure as in claim 13, wherein said cooperating threads include a stop for preventing threaded disengagement of said ball receiving portion from said collection container.

16. A closure as in claim 1, wherein said ball receiving internal surface of said socket includes an axle-support for receiving said axle of said ball for accommodating said rotative movement of said ball.

17. A closure as in claim 16, wherein said axle-support of said socket and said axle of said ball are parallel and eccentric with respect to each other.

18. A closure as in claim 16, wherein said axle of said ball comprises a pair of opposed protrusions on opposed surfaces of said ball and said axle-support of said socket comprises a generally spherical internal surface including a pair of opposed cavities, said opposed protrusions of said ball engaging said opposed cavities of said socket.

19. A closure as in claim 18, wherein said pair of opposed protrusions of said ball are generally cylindrical-shaped and said pair of opposed cavities of said socket include a pair of generally cylindrical bores for engagement therewith.

20. A closure as in claim 18, wherein said pair of opposed cavities of said socket include a pair of tapered surfaces and said pair of opposed protrusions of said ball include a pair of corresponding drafted surfaces for engagement therewith.

* * * * *